US005383241A

United States Patent [19]

Krieger

[11] Patent Number: 5,383,241

[45] Date of Patent: Jan. 24, 1995

[54] FLUID CONTROL METHOD

[75] Inventor: Joseph P. Krieger, Guthrie, Okla.

[73] Assignee: Hydro Modular Systems, Inc., Oklahoma City, Okla.

[21] Appl. No.: 118,070

[22] Filed: Sep. 8, 1993

[51] Int. Cl.[6] ..... D06F 33/02

[52] U.S. Cl. ..... 8/159; 68/12.12; 68/12.19; 68/902

[58] Field of Search ..... 8/158, 159; 68/12.02, 68/12.12, 12.19, 12.13, 207, 902, 17 R; 137/3, 561

[56] References Cited

U.S. PATENT DOCUMENTS

| | | | |
|---|---|---|---|
| 2,920,469 | 1/1960 | Henshaw, Jr. | 68/902 |
| 3,648,487 | 3/1972 | Hoffman | 68/12.19 |
| 4,382,382 | 5/1983 | Wang . | |
| 4,481,786 | 11/1984 | Bashark | 68/12.16 |
| 5,134,867 | 8/1992 | Kiuchi et al. | 68/12.02 |
| 5,173,184 | 12/1992 | Krieger . | |
| 5,252,792 | 10/1993 | Joyce . | |
| 5,259,219 | 11/1993 | Dausch et al. | 68/12.02 |
| 5,291,626 | 3/1994 | Molnaz et al. | 8/158 |
| 5,307,650 | 5/1994 | Mertz | 68/902 |

*Primary Examiner*—Frankie L. Stinson
*Attorney, Agent, or Firm*—Dunlap, Codding & Lee

[57] ABSTRACT

A treatment control system using a fluid using system wherein fluid is passed from the fluid using system during dump cycles occurring at periodic time intervals over a total dumping cycle. The fluid passed from the fluid using system during each dumping cycle is sampled and designated as a fluid dumping sample with each fluid dumping sample corresponding to the fluid passed from the fluid using system during one of the dump cycles. The total dissolved solids level in each of the fluid dumping samples is determined. Some of the dump cycles are designated as discharge cycles or treatment discharge cycles where the total dissolved solids level is above a predetermined high total dissolved solids level. Some of the dump cycles are designated as reuse cycles or treatment reuse cycles where the contaminant total dissolved solids level of the fluid dumping samples were determined to be below the predetermined high total dissolved solids level. The fluid is discharged or treated and discharged or reused or treated and reused in accordance with the determined cycle designation.

48 Claims, 4 Drawing Sheets

FLUID CONTROL METHOD

FIELD OF THE INVENTION

The present invention relates generally to fluid control systems and, more particularly, but not by way of limitation, to a fluid control system having a fluid using system wherein fluid is passed from the fluid using system during dumping cycles occurring at periodic time intervals and the fluid passed from the fluid using system during each of the dumping cycles automatically is either discharged from the fluid control system or automatically passed through a fluid treatment system and discharged or automatically passed through a fluid treatment system and back into the fluid using system for reuse or automatically passed back into the fluid using system for reuse.

BRIEF DESCRIPTION OF THE DRAWINGS

FIG. 8 is a schematic, diagrammatic view of a modified fluid control system using washers like the washers shown in FIG. 3 and operating like the fluid control system shown in FIG. 1.

DESCRIPTION OF THE PREFERRED EMBODIMENTS

Figure 1:
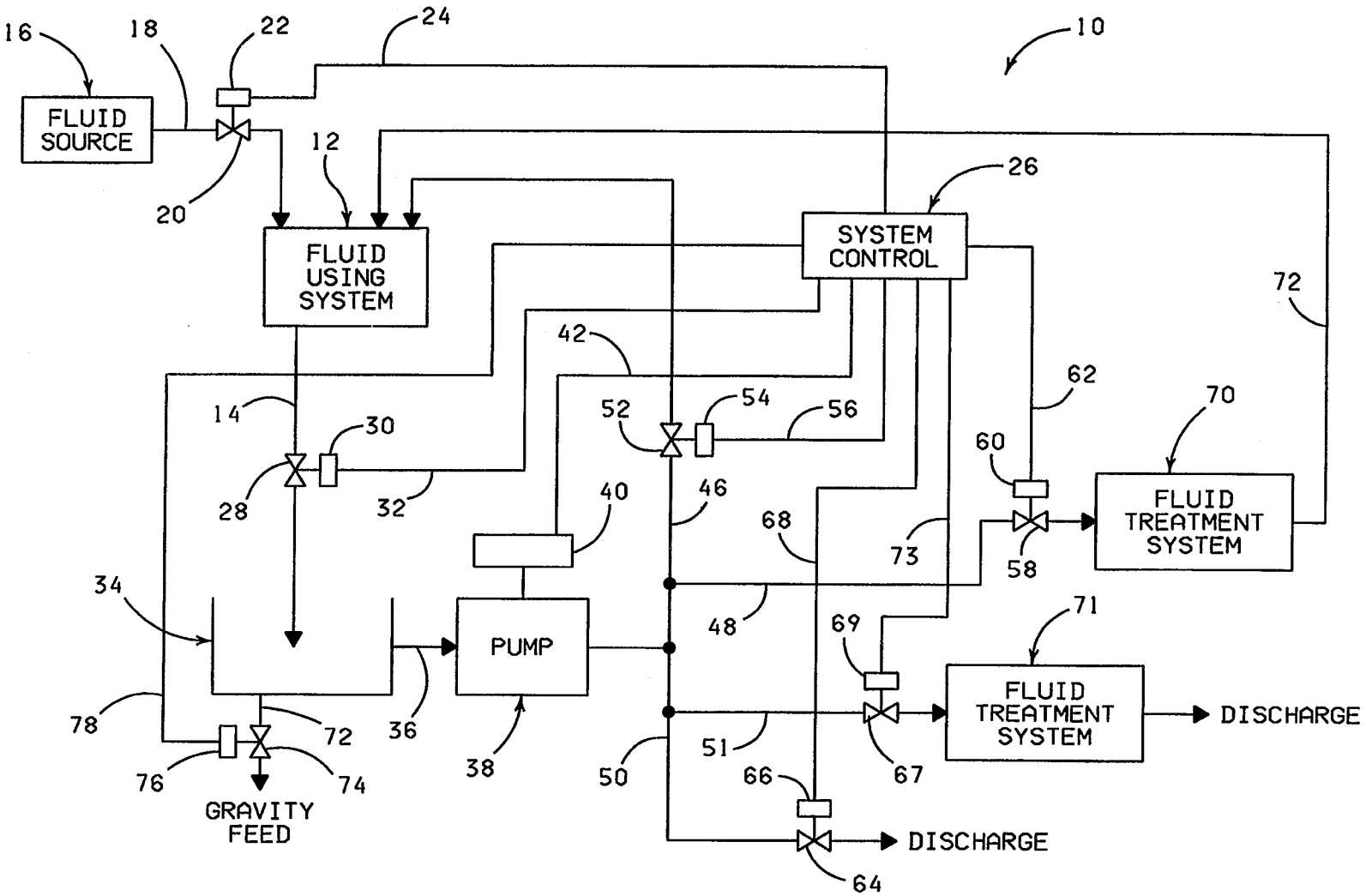
FIG. 1 is a diagrammatic, schematic view of a fluid control system constructed and operating in accordance with the present invention.

Shown in FIG. 1 is a schematic, diagrammatic view of a fluid control system 10 constructed and operating in accordance with the present invention.

The fluid treatment system 10 includes a fluid using system 12. The fluid using system 12 represents any system which utilizes a fluid and which passes fluid from the fluid using system 12 during at least two dumping cycles occurring at periodic time intervals over a total dumping cycle occurring over a total predetermined time.

For example, the fluid using system 12 may be a washer for washing clothes on a commercial level where water is passed into the fluid using system 12 (washer) along with the clothes, the water is mixed with the clothes and the water after having been mixed or agitated with the clothes then is passed from the fluid using system 12 via a conduit 14 during a first dumping cycle. Water then is passed into the fluid using system 12 along with a dye. The dye and water then are agitated with the clothes and the water-dye mixture is dumped or passed from the fluid using system 12 via the conduit 14 during a second dumping cycle. Water and a surfactant is passed into the washer, and the water-surfactant then is dumped from the washer during a third dumping cycle. Water then is passed into the fluid using system 12 and mixed with the clothes for rinsing the clothes and the water then is dumped from the fluid using system 12 via the conduit 14 during a fourth dumping cycle. The first, second, third and fourth dumping cycles just described constitute the total dumping cycle and this total dumping cycle may be repeated a number of times over a given time period such as a day.

It should be noted that, although only four dumping cycles have been described before with respect to the fluid using system 12 comprising a washer or washers, it is common in such commercial washing systems to have more than four dumping cycles of the general type just described during a given total dumping cycle (the total number of times water and/or surfactant and/or other additives are passed into and dumped from the fluid using system 12 during a particular wash cycle). The fluid control system 10 of the present invention specifically is designed to be used with any fluid using system which has at least two dumping cycles comprising the total dumping cycle.

As the fluid is being passed from the fluid using system 12 during each of the dumping cycles and during a system calibration phase, the fluid is sampled. The sampled fluid taken during each of the dumping cycles sometimes is referred to herein as the fluid dumping samples.

During the system calibration phase, the total dissolved solids level is determined for each of the fluid dumping samples. In addition, the total suspended solids is determined for each of the fluid dumping samples.

The total dissolved solids in a particular fluid sample may be determined using any commercially available system or device, and such systems and/or devices are well known in the art. The total suspended solids in the fluid dumping samples may be determined by visual inspection or may be determined by laboratory analysis or may be determined by knowing the type of additive such as a particular dye which has been added to the fluid using system 12.

Initially, a predetermined high total dissolved solids level is determined for a particular fluid control system 10. For example, the predetermined high total dissolved solids level may be determined to be one thousand parts per million in a particular fluid control system 10 for example. In this example, if the particular fluid dumping sample was determined to have a total dissolved solids level below the predetermined high total dissolved solids level and no objectionable suspended solids, the fluid dumped during that fluid dumping cycle is recirculated back into the fluid using system 12 for reuse. If the fluid dumping sample was determined to have a total dissolved solids level below the predetermined high total dissolved solids level of one thousand parts per million and had suspended solids therein which were subject to being removed therefrom, the fluid dumped during that particular dumping cycle is filtered and/or treated and then recirculated back into the fluid using system 12 for reuse. If the fluid dumping sample was determined to have a total dissolved solids level above the predetermined high total dissolved solids level of one thousand parts per million and no objectionable suspended solids, the fluid dumped during that particular dumping cycle is discharged to the sewer. If the fluid dumping sample was determined to have a total dissolved solids level above the predetermined high total dissolved solids level and suspended solids of the type which can be treated and removed, the fluid dumped during that dumping cycle would be filtered and/or treated to substantially reduce the suspended solids level and then discharged to the sewer.

During the system calibration phase, each of the dumping cycles, based on the fluid dumping sample taken during that dumping cycle, is designated as one of the following designations (a) a discharge cycle, (b) a reuse cycle, (c) a treatment reuse cycle, or (d) a treatment discharge cycle. If the fluid dumping sample is determined to have a total dissolved solids level below the predetermined high total dissolved solids level and no objectionable suspended solids therein, the dumping cycle is designated as a reuse cycle. If the fluid dumping sample is determined to have a total dissolved solids level below the predetermined high total dissolved solids level and suspended solids which are filterable and/or treatable therein, that particular discharge cycle is designated as a treatment reuse cycle. If the fluid dumping sample is determined to have a total high dissolved solids level above the predetermined high total dissolved solids level and no objectionable suspended solids therein, that particular dumping cycle is designated as a discharge cycle. If the fluid dumping sample is determined to have a total dissolved solids level above the predetermined high total dissolved solids level and suspended solids which are filterable and/or treatable therein, that particular dumping cycle is designated as a treatment discharge cycle.

The fluid control system 10 is designed to automatically pass the fluid passed from the fluid using system 12 during each of the discharge cycles to discharge (FIG. 1) discharging such fluid from the fluid treatment system 10 such as into a sewer system. The fluid control system 10 is designed to automatically pass the fluid passed from the fluid using system 12 during each of the reuse cycles back into the fluid using system 12. The fluid control system 10 is designed to automatically pass the fluid passed from the fluid using system 12 during each of the treatment reuse cycles through a fluid treatment system 70 designed to reduce the suspended solids level in such fluid to an acceptable level with the fluid then being passed back into the fluid using system 12. The fluid control system 10 is designed to automatically pass the fluid passed from the fluid using system 12 during each treatment discharge cycle through a fluid treatment system 71 designed to reduce the suspended solids level in such fluid to an acceptable level with the fluid then being discharged from the fluid control system 10.

The term "discharge" as used herein and as shown in FIG. 1 simply means that the fluid is discharged from the fluid control system 10. The fluid could be discharged to another system for use or treatment herein or to a sewer discharge for example.

The fluid control system 10 of the present invention is constructed and operated to provide a maximum reuse of the fluid in the fluid using system 12 while maintaining the total dissolved solids level in the fluid being used in the fluid using system 12 below the predetermined high total dissolved solids level.

Fluid is passed into the fluid using system 12 from a fluid source 16 by way of a conduit 18. A valve 20 is interposed in the conduit 18. A controller 22 is connected to the valve 20. The controller 22 is adapted to receive a signal via a signal path 24 from a system control 26. In response to receiving a signal from the system control 26 in one mode of operation, the controller 22 opens the valve 20 thereby causing fluid to be passed from the fluid source 16 into the fluid using system 12. In response to receiving a signal from the system control 26 in one other mode of operation, the controller 22 closes the valve 20 thereby interrupting the flow of fluid from the fluid source 16 to the fluid using system 12.

A valve 28 is interposed in the conduit 14. A controller 30 is connected to the valve 28. In one mode of operation, the controller 30 receives a signal via a signal path 32 from the system control 26 and, in response thereto, the controller 30 opens the valve 28 permitting fluid to pass from the fluid using system 12. In one other mode of operation, the controller 30 receives a signal from the system control 26 and, in response thereto, the controller 30 closes the valve 28 thereby interrupting the flow of fluid from the fluid using system 12 through the conduit 14.

The conduit 14 is positioned to pass fluid from the fluid using system 12 into a dump tank 34. A conduit 36 is connected to the dump tank 34 for passing fluid from the dump tank 34.

A pump 38 is interposed in the conduit 36. A pump controller 40 is connected to the pump 38. In one mode of operation, the pump controller 40 receives a signal via a signal path 42 from the system control 26 and, in response thereto, the pump controller 40 turns the pump 38 in the on condition for pumping fluid from the dump tank 34 through the conduit 36. In one other mode of operation, the pump controller 40 receives a signal from the system control 26 and, in response thereto the pump controller 40 turns the pump in the off condition thereby ceasing the pumping of fluid from the dump tank 34.

The pump 38 pumpingly discharges the fluid therefrom through the conduit 36. The fluid discharge from the pump 38 is pumped either through a conduit 46 or through a conduit 48 or through a conduit 50 or through a conduit 51.

A valve 52 is interposed in the conduit 46. A controller 54 is connected to the valve 52. The controller 54 is adapted to receive a signal from the system control 26 over a signal path 56. In one mode of operation, the controller 54 receives a signal from the system control 26 and, in response thereto, the controller 54 opens the valve 52 thereby permitting fluid to pass from the pump 38 through the conduit 46. The fluid is passed through the conduit 46 back into the fluid using system 12 in the open position of the valve 52. In one other mode of operation, the controller 54 receives a signal from the system control 26 and, in response thereto, the controller 54 causes the valve 52 to be closed thereby interrupting fluid flow through the conduit 46.

A valve 58 is interposed in the conduit 48. A controller 60 is connected to the valve 58. In one mode of operation, the controller 60 is adapted to receive a signal via a signal path 62 from the system control 26, and in response thereto, the controller 60 opens the valve 58 thereby permitting fluid to pass through the conduit 48. In one other mode of operation, the controller 60 receives a signal from the system control 26 and, in response thereto, the controller 60 causes the valve 58 to be closed thereby interrupting the flow of fluid through the conduit 48.

A valve 64 is interposed in the conduit 50. A controller 66 is connected to the valve 64. In one mode of operation, the controller 66 is adapted to receive a signal from the system control 26 via a signal path 68 and, in response thereto, the controller 66 causes the valve 64 to be opened thereby permitting fluid to be passed through the conduit 50 to discharge. In one other mode of operation, the controller 66 is adapted to receive a signal from the system control 26 via the signal path 68 and, in response thereto, the controller 66 causes the valve 64 to be closed thereby interrupting the flow of fluid through the conduit 50.

A valve 67 is interposed in the conduit 51. A controller 69 is connected to the valve 67. In one mode of operation, the controller 69 is adapted to receive a signal from the system control 26 via a signal path 73 and, in response thereto, the controller 69 causes the valve 67 to be opened thereby permitting fluid to be passed through the conduit 67. In one other mode of operation, the controller 69 is adapted to receive a signal from the system control 26 via the signal path 73 and, in response thereto, the controller 69 causes the valve 67 to be closed thereby interrupting the flow of fluid through the conduit 51.

The fluid passing through the conduit 48 in the open position of the valve 58 is passed through the fluid treatment system 70. The fluid treatment system 70 is constructed and adapted to reduce the suspended solids in the fluid being passed through the fluid treatment system 70. The fluid treatment system 70 may be constructed and operated in the manner described in U.S. Pat. No. 5,173,184, titled Wastewater Treatment Apparatus and Method, issued to Joseph P. Krieger on Dec. 22, 1992, the disclosure of this patent specifically being incorporated herein by reference.

The fluid is passed from the fluid treatment system 70 through a conduit 72 and back into the fluid using system 12 for reuse.

The fluid passing through the conduit 51 in the open position of the valve 67 is passed through the fluid treatment system 71. The fluid treatment system 71 is constructed and adapted to reduce the suspended solids in the fluid being passed through the fluid treatment system 71. The fluid treatment system 71 may be constructed and operated in a manner described in U.S. Pat. No. 5,173,184, referred to before.

It should be noted that the system control 26 is designed to control the fluid passed from the fluid treatment system 70 and the fluid source 16 so that the fluid using system 12 receives the required amount of fluid at the required times. In some applications, the fluid passed from the fluid treatment system 70 may be passed into a holding tank (not shown) and then passed from the holding tank into the fluid using system 12 through a control valve operated by the system control 26 for coordinating the fluid passed from the fluid treatment system 70 and the fluid source 16.

The valves and controllers described herein may be electrically operated, hydraulic powered or pneumatically operated. Valves and controllers constructed to operate in the manner described herein are commercially available and well known in the art. Further, system controls designed to output signals to such controllers at predetermined times in the manner described herein with respect to the system control 26 are well known in the art and a detailed description of such system control is not deemed necessary herein.

In operation and during a system operating phase, the fluid control system 10 and, more particularly fluid using system 12 is operated through at least one total dumping cycle. The fluid dumping samples collected during each of the dumping cycles are analyzed. Some of the dumping cycles are designated discharge cycles where the total dissolved solids are above the predetermined high total dissolved solids level and the suspended solids level is satisfactorily low or the suspended solids are not objectionable. Some of the dumping cycles are designated as reuse cycles where the fluid dumping sample was tested to have a total dissolved solids level below the predetermined high total dissolved solids level and there are no objectionable suspended solids. Some of the dumping cycles are designated as treatment reuse cycles where the fluid dumping sample was tested to have a total dissolved solids level below the predetermined high total dissolved solids level and the suspended solids were determined to be treatable and/or filterable to an acceptable level. Some of the dumping cycles are designated as treatment discharge cycles where the fluid dumping sample was tested to have a total dissolved solids level above the predetermined high total dissolved solids level and the suspended solid were determined to be treatable and/or filterable to an acceptable level for discharge.

The first determination to be made during the system calibration phase thus is whether or not the total dissolved solids level in the fluid exceeds the predetermined high total dissolved solids level. If it is determined that the total dissolved solids level in the fluid is below the predetermined high total dissolved solids level, then it must be determined whether or not the fluid contains suspended solids and the nature of such suspended solids. If the fluid contains suspended solids which are treatable to an acceptable level such as emulsified oil and grease for example, the particular dumping cycle then is designated as a treatment reuse cycle. If the total dissolved solids level is above the predetermined high total dissolved solids level and the fluid contains no suspended solids such as oil and grease or dyes for example, then the particular dumping cycle is designated as a discharge cycle. On the other hand, if the total dissolved solids level is above the predetermined high total dissolved solids level and the fluid contains suspended solids such as dyes or oil and grease, the particular cycle then is designated as a treatment discharge cycle. The primary purpose of the treatment is to remove the suspended solids or to reduce the suspended solids in the fluid being discharged or reused to an acceptable level. In some instances, even where the total dissolved solids level is below the predetermined high total dissolved solids level, the fluid may contain suspended solids such as particular dyes which are not acceptable for use in the fluid using system 12, then such cycle is designated as a treatment discharge cycle.

In some applications, the treatment cycles may be eliminated. In these instances, only the discharge cycles and the reuse cycles are utilized in the fluid treatment system 10. In these last-mentioned instances, the fluid treatment systems 70 and 71 along with the interconnecting conduits are eliminated.

In some applications, the fluid control system 10 may include only the discharge cycle and the treatment reuse cycle. In other applications, the fluid control system 10 may include only the discharge cycle and the treatment discharge cycle.

In some applications, the fluid control system 10 may include only the reuse cycle and the treatment reuse cycle. In some applications, the fluid control system 10 may include only the reuse cycle and the treatment discharge cycle. In some applications, the fluid control system 10 may include only the discharge cycle, the reuse cycle and the treatment reuse cycle. In some applications, the fluid control system 10 may include only the discharge cycle, the treatment reuse cycle and the treatment discharge cycle. In some applications, the fluid control system 10 may include only the reuse cycle, the treatment reuse cycle and the treatment discharge cycle. In some applications the fluid control system 10 may include only the discharge cycle, the reuse cycle and the treatment discharge cycle. In short, in any given application, the fluid control system 10 may include any combination of the discharge cycle, the reuse cycle, the treatment reuse cycle and/or the treatment discharge cycle.

Once the discharge cycles, the reuse cycles, the treatment reuse cycles and the treatment discharge cycles have been designated, these are inputted into the system control 26 along with the respective times for initiating and terminating each such cycle. The system control 26 also is inputted with information sufficient to permit the system control 26 to operate the controller 22 for causing the valve 20 to be opened and closed at predetermined time intervals for passing fluid from the fluid source 16 into the fluid using system 12 with this being coordinated with the fluid passed from the fluid treatment system 70 back into the fluid using system 12 for reuse. These times depend upon the particular fluid treatment system 10. However, these times are known for existing fluid using systems 12.

For the purpose of illustration, it will be assumed that the fluid using system 12 passes at least some of the fluid therein through the conduit 14 during four dumping cycles (total dumping cycle) with dumping cycle one occurring at a time $T_1$, dumping cycle two occurring at a time $T_2$, dumping cycle three occurring at a time $T_3$ and dumping cycle four occurring at a time $T_4$. The total dumping cycle may be repeated numerous times over a given time period.

In this example and during the system calibration phase, it will be assumed that the fluid dumping sample taken during the first dumping cycle beginning at a time $T_1$ has a total dissolved solids level above the predetermined high total dissolved solids level and suspended solids at an acceptable level, and that this first dumping cycle then is designated as a discharge cycle. The fluid dumping sample taken during the second dumping cycle beginning at a time $T_2$ has a total dissolved solids level below the predetermined total dissolved solids level and suspended solids at an acceptable level, and thus the second dumping cycle is designated as a reuse cycle. The fluid dumping sample taken during the third dumping cycle beginning at a time $T_3$ has a total dissolved solids level below the predetermined high total dissolved solids level and suspended solids which are filterable and/or treatable to an acceptable level, and thus the third dumping cycle is designated as a treatment reuse cycle. The fluid dumping sample taken during the fourth dumping cycle beginning at a time $T_4$ has a total dissolved solids level above the predetermined total dissolved solids level and suspended solids which are filterable and/or treatable to an acceptable level, and thus the fourth dumping cycle is designated as a treatment discharge cycle.

Following this example and during the system calibration phase, the system control 26 is programmed or otherwise set to pass fluid into the fluid using system 12 at the appropriate times, to operate the valve 28 to dump or pass fluid from the fluid using system 12 during the first, the second, the third and the fourth dumping cycles, and to operate the valves 52, 58 and 64 to open and close such valves respectively depending upon whether a particular dumping cycle has been designated as a discharge cycle, a reuse cycle or treatment reuse cycle or treatment discharge cycle.

During the system operating phase and when the system control 26 determines that it is time to initiate the first dumping cycle (discharge cycle), the system control 26 outputs a signal on the signal path 32 causing the controller 30 to open the valve 28 thereby causing fluid to be passed from the fluid using system 12 through the conduit 14 and into the dump tank 34 beginning at the time $T_1$. The system control 26 maintains the valve 28 in the opened position for a predetermined period of time to dump all or a predetermined portion of the fluid from the fluid using system 12. At the end of that predetermined period of time or after all of the fluid is dumped from the fluid using system 12, the system control outputs a signal on the signal path 32 for causing the controller 30 to close the valve 28.

During the first dumping cycle, the system control 26 outputs a signal on the signal path 42 causing the pump controller 40 to start the pump 38 after the fluid has been passed into the dump tank during the first dumping cycle or during the passing of the fluid into the dump tank 34 during the first dumping cycle, as determined in a particular application. The system control 26 also and before starting the pump 38 outputs a signal on signal paths 56, 62 and 73 causing the respective controllers 54, 60 and 69 to operate the valves 52, 58 and 67 associated therewith to close the valves 52, 58 and 67, and the system control 26 outputs a signal on the signal path 68 causing the controller 66 to open the valve 64.

Thus, during the first dumping cycle (discharge cycle), the pump 38 pumps fluid from the dump tank 34 through the conduits 36 and 50 to discharge. After the fluid has been pumped from the dump tank 34 to discharge during the first dumping cycle (discharge cycle), the system control 26 outputs a signal on the signal path 42 causing the pump controller 40 to turn the pump 38 to the off condition, and the system control 26 outputs a signal on the signal path 68 causing the controller 66 to close the valve 64.

In the alternative and during the discharge cycle, the dump tank 34 includes a discharge conduit 72 connected to the dump tank 34 for draining the fluid in the dump tank 34 via gravity. A valve 74 is interposed in the conduit 72. A controller 76 is connected to the valve 74. The controller 76 is adapted to receive a signal from the system control 26 over a signal path 78. During the discharge cycle, the controller outputs a signal on a signal path 78 to the controller 76 causing the controller 76 to open the valve 74 thereby resulting in the fluid in the dump tank 34 being drained or discharged through the conduit 72.

When it is time ($T_2$) to initiate the second dumping cycle (reuse cycle), the system control 26 outputs the signal on the signal path 32 causing the controller 30 to open the valve 28 thereby causing fluid to pass from the fluid using system 12 into the dump tank 34 beginning at a time $T_2$. In this mode, the system control 26 also outputs a signal on the signal path 56 causing the controller 54 to open the valve 52 and the system control 26 outputs signals on the signal paths 62, 68 and 73 to cause the respective controllers 60, 66 and 69 to close the valves 58, 64 and 67 associated therewith.

When the fluid has been passed into the dump tank 34 during the second dumping cycle (reuse cycle) or during the passing of the fluid into the dump tank 34 during the second dumping cycle (reuse cycle), the system control 26 outputs a signal on the signal path 42 causing the pump controller 40 to start the pump 38. The pump 38 in this mode pumps the fluid from the dump tank 34 through the conduit 46 and recycles such fluid back into the fluid using system 12.

At the end of the second dumping cycle (reuse cycle), the system control 26 outputs a signal on the signal path 32 causing the controller 30 to close the valve 28 and the system control 26 outputs a signal on the signal path 56 causing the controller 54 to close the valve 52, and the system control 26 outputs a signal on the signal path 42 causing the pump controller 40 to turn the pump 38 to the off condition.

To initiate the third dumping cycle (treatment reuse cycle), the system control 26 outputs a signal on the signal path 32 causing the controller 30 to open the valve 28 thereby resulting in fluid passing from the fluid using system 12 into the dump tank 34 beginning at the time $T_3$. Either after the fluid has been passed into the dump tank 34 or during the passing of the fluid into the dump tank 34, the system control 26 outputs a signal on the signal path 62 causing the controller 60 to open the valve 58 and the system control 26 outputs a signal on the signal path 42 causing the pump controller 40 to condition the pump 38 in the on condition.

In this mode, the pump 38 pumps the fluid from the dump tank 34 through the conduits 36 and 48 and into and through the fluid treatment system 70. The fluid is treated in the fluid treatment system 70 to reduce the suspended solids in the fluid to an acceptable level. The fluid is passed from the fluid treatment system 70 through the conduit 72 and recycled back into the fluid using system 12. At the end of the third dumping cycle (treatment cycle) the system control 26 outputs a signal on the signal path 32 causing the controller 30 to close the valve 28, the system control 26 outputs a signal on the signal path 42 causing the pump controller 40 to condition the pump 38 in the off condition and the system control 26 outputs a signal on the signal path 62 causing the controller 60 to close the valve 58.

To initiate the fourth dumping cycle (treatment discharge cycle), the system control 26 outputs a signal on the signal path 32 at the time $T_4$ causing the controller 30 to open the valve 28 thereby causing fluid to be passed from the fluid using system 12 through the conduit 14 and into the dump tank 34. During the fourth dumping cycle (treatment discharge cycle), the system control 26 outputs a signal on the signal path 42 causing the pump controller 40 to start the pump 38 after the fluid has been passed into the dump tank 34 during the fourth dumping cycle or during the passing of the fluid into the dump tank 34 during the fourth dumping cycle as determined in a particular application. The system control 26 also and before starting the pump 38 outputs signals on the signal paths 56, 62 and 68 causing the respective controllers 54, 60 and 66 to operate the valves associated therewith to close the valves 52, 58 and 64. The system control 26 outputs a signal on the signal path 73 causing the controller 69 to open the valve 67. Thus, during the fourth dumping cycle (treatment discharge cycle), the pump 38 pumps the fluid from the discharge tank 34 through the conduits 36 and 51. The fluid is passed through the conduit 51 into the fluid treatment system 71. The fluid is treated in the fluid system 71 to remove suspended solids and to bring the suspended solids in the fluid to the desired level. The fluid then is discharged from the fluid treatment system 71 to discharge.

After the fluid has been pumped from the dump tank 34 to discharge during the fourth dumping cycle (treatment discharge cycle), a system control 26 outputs a signal on the signal path 42 causing the pump controller 40 to turn the pump to the off condition and the system control 26 outputs a signal on the signal path 73 causing the controller 69 to close the valve 67.

The total dumping cycle just described may be repeated a number of times over any operational period of time such as over a day or a work shift for example.

It should be noted that, assuming the valves 52, 58, 64 and 67 initially are in the closed position, it is not necessary that the system control 26 output signals for controlling selected ones of these valves at the beginning of each of the dumping cycles.

Figure 2:
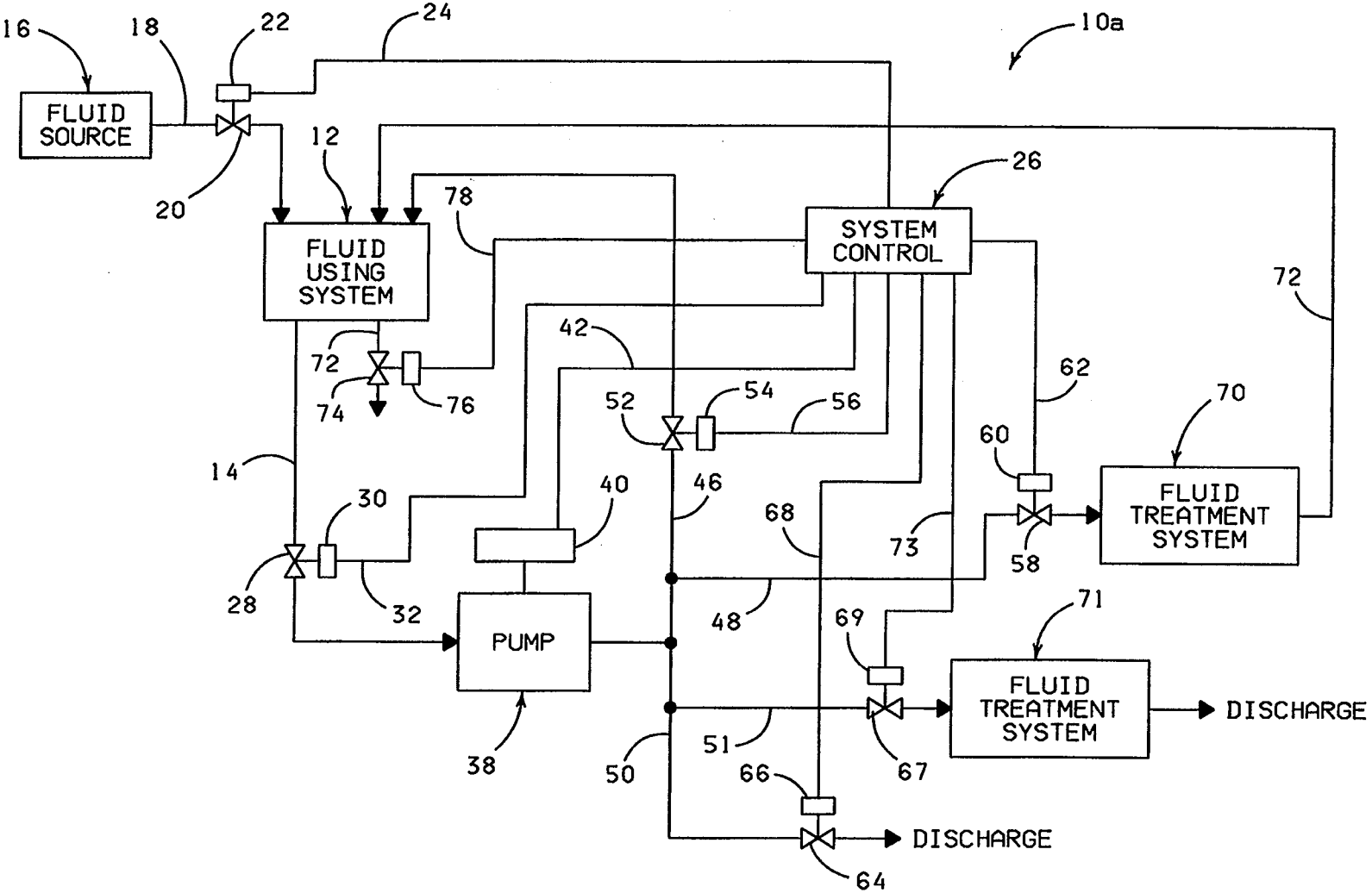
FIG. 2 is a diagrammatic, schematic view of a modified fluid control system constructed and operating in accordance with the present invention.

Embodiment of FIG. 2

Shown in FIG. 2 is a fluid control system 10*a* which is constructed and operates exactly like the fluid control system 10 shown in FIG. 1 and described in detail before, except the fluid control system 10*a* does not include a dump tank like the dump tank 34. In the fluid control system 10*a*, the fluid is passed from the fluid using system 12 through the conduit 14 during each of the dumping cycles and directly into the pump 38. Otherwise, the fluid control system 10*a* will operate exactly like the fluid control system 10 shown in FIG. 1 and described in detail before. Thus, components in FIG. 2 which operate like components in FIG. 1 have been given the same reference numeral.

Embodiment of FIGS. 3, 4, 5, 6 and 7

Shown in FIGS. 3, 4, 5, 6 and 7 is a portion of a fluid control system 10b constructed basically like the fluid control system 10 shown in FIG. 1 and described in detail before. In this example, the fluid control system 10b more particularly includes a washer 80 (FIG. 3) which is of the type of washer commercially available for washing clothes and commonly referred to as a wash wheel. Components in FIGS. 3, 4, 5, 6 and 7 which operate like the components in FIG. 1 have been given the same reference numeral.

Figure 3:
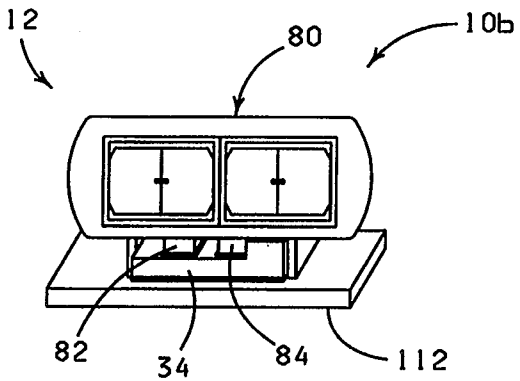
FIG. 3 is a portion of a fluid control system incorporating washers constructed and operating in accordance with the system schematically shown in FIG. 1.

The washer 80 has two discharge conduits 82 (FIG. 3) and 84 (FIG. 3). A control valve (not shown) is located in each of the discharge conduits 82 and 84. Such valves include valve controllers (not shown) and are connected to a system control (not shown). The discharge conduits 82 and 84 function like the conduit 14 (FIG. 1) and the valves in the discharge conduits 82 and 84 and the associated valve controllers function like the valve 28 (FIG. 1) and controller 30 (FIG. 1).

The discharge conduits 82 and 84 are connected to the dump tank 34 (FIGS. 4, 5, 6 and 7). The discharge conduit 82 is in fluidic communication with an opening 86 (FIGS. 4 and 5) in the dump tank 34. The discharge conduit 84 is in fluidic communication with an opening 88 (FIGS. 4 and 5) in the dump tank 34.

Figure 4:
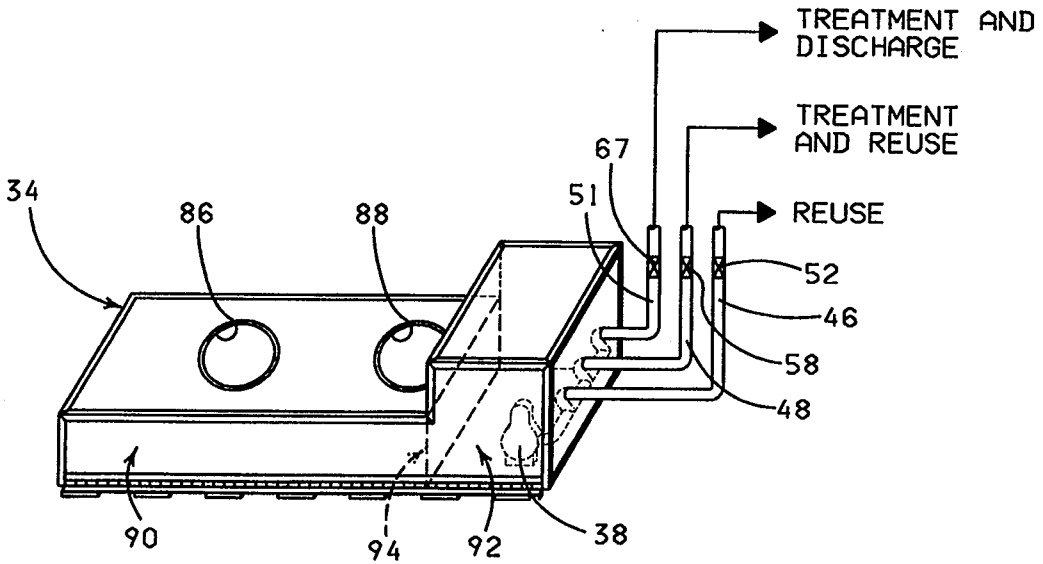
FIG. 4 is a diagrammatic, partial perspective view of the dump tank portion of the fluid control system of FIG. 3.
Figure 7:
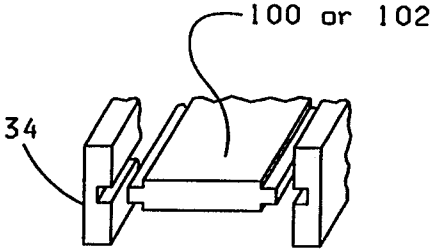
FIG. 7 is a partial perspective view showing a portion of the door and channel portion of the dump tank of FIGS. 3 and 4.
Figure 5:
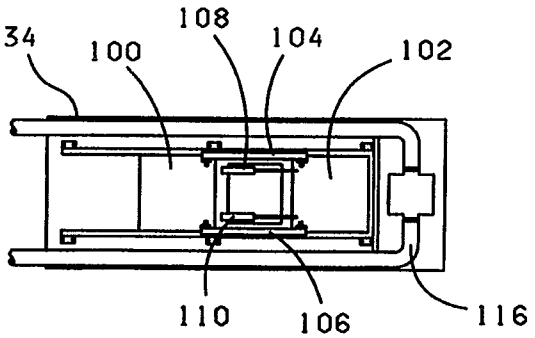
FIG. 5 is a top elevational view of the dump tank portion of the fluid control system shown in FIGS. 3 and 4.

The dump tank 34 is divided into two sections, a first section 90 (FIGS. 4 and 5) and a second section 92 (FIGS. 4 and 5). A screen 94 (shown in dashed lines in FIGS. 4 and 5) is interposed between the first section 90 and the second section 92.

The pump 38 is disposed in the second section 92 of the dump tank 34. The pump 38 (shown in dashed lines in FIG. 4) is adapted to pump the fluid from the second section 92 through either conduits 46 (FIG. 4) or 48 (FIG. 4) or 51 (FIG. 4). The valve 52 is interposed in the conduit 46. The valve 58 is interposed in the conduit 48. The valve 67 (FIG. 4) is interposed in the conduit 51. The valves 52, 58 and 67 are associated with the respective controllers (not shown in FIG. 4) and function and operate like the valves 52, 58 and 67 shown in FIG. 1.

A pair of sliding doors 100 (FIGS. 6 and 7) and 102 (FIGS. 6 and 7) are slidingly disposed on the bottom of the dump tank 34. The doors 100 and 102 each are movable to a closed position (FIG. 6) and to an open position. Openings (not shown) are formed in the bottom of the dump tank 34 and each of the doors 100 and 102 is disposed over and encloses one of the openings in the closed position of the doors 100 and 102.

Figure 6:
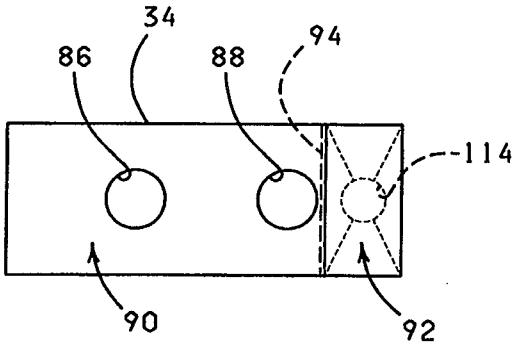
FIG. 6 is a bottom elevational view of the dump tank shown in FIGS. 3 and 4.
Figure 4:
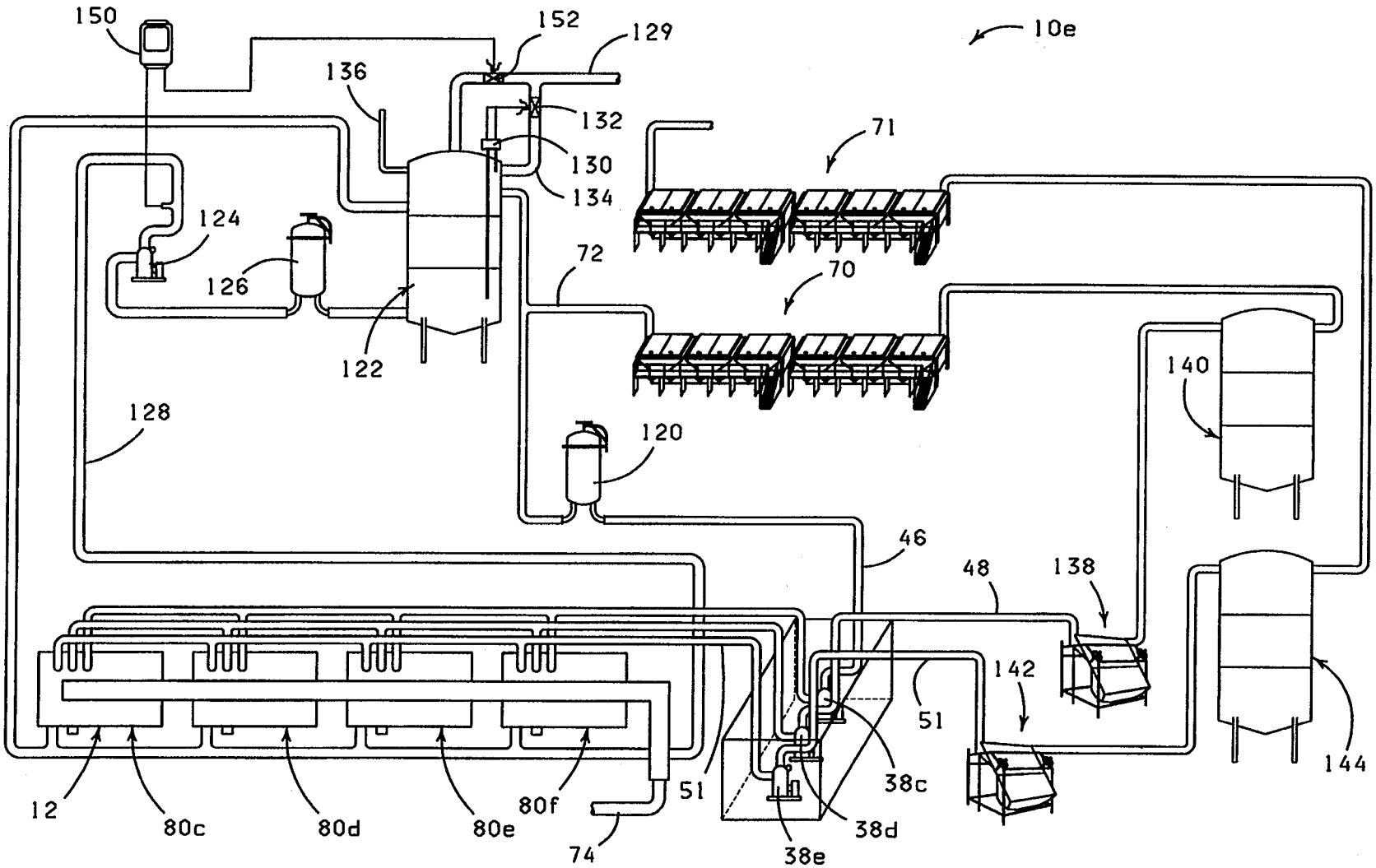

The doors 100 and 102 are interconnected by way of members 104 (FIG. 6) and 106 (FIG. 6). The rods of a pair of hydraulic or pneumatic cylinders 108 (FIG. 6) and 110 (FIG. 6) are connected to the door 102. When actuated, the cylinder rods are withdrawn into the hydraulic or pneumatic cylinders 108 and 110 thereby moving the sliding door 102 and the sliding door 100 connected thereto in a direction removing the sliding doors 100 and 102 from the openings in the bottom of the dump tank 34 for dumping the fluid in the first section 90 into a pit 112 (FIG. 3).

The bottom of the second section 92 is tapered toward a drain opening 114 (shown in dashed lines in FIG. 5). The drain opening 114 is connected to a discharge conduit 116 (FIG. 6).

In operation, the system control (not shown in FIGS. 3, 4, 5, 6 and 7) functions to dump the fluid in the washer 80 through the conduits 82 and 84 into the dump tank 34 during the dumping cycles in the manner described before in connection with FIG. 1 and the control of the valve 28 via the controller 30 (FIG. 1). Assuming the particular dumping cycle has been designated as a discharge cycle, the system control actuates the hydraulic or pneumatic cylinders 108 and 110 to move the doors 100 and 102 to the opened position thereby permitting the fluid in the dump tank 34 to be discharged into the pit 112. The doors 100 and 102 function like the valve 64 (FIG. 1) and the hydraulic or pneumatic cylinders 108 and 110 function like the controller 66 (FIG. 1) to discharge the fluid in the dump tank 34 to discharge during any dumping cycle designated as a discharge cycle.

The fluid in the second section 92 is pumped via the pump 38 through the conduit 46 and back to the fluid using system 12 (washer 80) as controlled by the system control (not shown in FIGS. 3, 4, 5, 6 and 7) in a manner like the valve 52 (FIG. 1) and associated controller 54 (FIG. 1).

The pump 38 pumps the fluid from the second section 92 of the dump tank 34 through the conduit 48 to the treatment system 70 as controlled by the valve 58 in a manner like that described before with respect to the valve 58 (FIG. 1) and associated controller 60 (FIG. 1).

The pump 38 pumps the fluid in the second section 92 of the dump tank 34 through the conduit 51 to the treatment system 71 and the fluid then is discharged from such treatment system 71 to discharge. The conduit 51 and associated valve 67 cooperate to pass the fluid from the dump tank 34 through the treatment system 71 and to discharge in a manner like that described in connection with FIG. 1.

In some applications, it may be desirable to dump the fluid in the second section 92 to discharge. In this situation, the system control (not shown in FIGS. 3, 4, 5, 6 and 7) is connected to a valve (not shown) interposed in the drain opening 114 for draining or discharging the fluid through the drain opening 114 and through the discharge conduit 116. The fluid in the second section 92 is drained via gravity through the drain opening 114 and passed through the discharge conduit 116.

It should be noted that the pump 38 does not have to be disposed in the second section 92, as shown in FIG. 4. The pump 38 may be located at a position outside the dump tank 34 as schematically illustrated in FIG. 1.

Embodiment of FIG. 8

Shown in FIG. 8 is a fluid control system **10*e* which is constructed and operates in a manner like the fluid control system 10*b* shown in FIG. 2 and described in detail before. The fluid control system 10*e* includes a plurality of fluid using systems 12 which in this case represent a plurality of commercial washers or wash wheels 80 like the wash wheels 80 shown in FIG. 3 and described before. The wash wheels or washers 80 are designated in FIG. 8 by the respective reference numerals 80*c*, 80*d*, 80*e* and 80*f*. The wash wheels 80*c*, 80*d*, 80*e* and 80*f* each include dump tanks (not specifically shown in FIG. 8) constructed like the dump tank 34 shown in FIGS. 3, 4, 5, 6 and 7 and described in detail before and each are associated with a pit like the pit 112** shown in FIG. 3 and described in detail before.

Each of the washers **80*c*, 80*d*, 80*e* and 80*f* dumps fluid from the respective washers during the various dumping cycles over a total dumping cycle. The dumping cycles and the total dumping cycle for each of the washers 80*c*, 80*d*, 80*e* and 80*f*** may be identical or they may be different.

During each discharge cycle for each of the washers **80*c*, 80*d*, 80*e* and 80*f*, the sliding doors 100 and 102 (FIGS. 6 and 7) are opened thereby dumping or passing the fluid from the respective dump tanks 34*c*, 34*c*, 34*e* and 34*f* into the pit 112. The fluid is discharged from the pit through the conduit 74**.

The fluid control system **10*e* includes three pumps 38*c*, 38*d* and 38*e*. The pumps 38*c*, 38*d* and 38*e* function like the pump 38** shown in FIG. 2, as will be made more apparent below.

During each reuse cycle, the pump **38*c* is turned on and the valve 52 (FIG. 1) is opened via the controller 54 (FIG. 1) for pumping fluid from any one or more of the dump tanks associated with the washers 80*c*, 80*d*, 80*e* and/or 80*f*. The fluid is pumped through the conduit 46 and through a filter 120 and into a tank 122**.

The fluid is held in the tank 122. When the fluid is required in any one of the washers **80*c*, 80*d*, 80*e* and 80*f*, fluid is pumped from the tank 122 by a pump 124 through a filter 126 and through a conduit 128 to the washers 80*c*, 80*d*, 80*e* and 80*f*. The conduit 128 is connected to each of the washers 80*c*, 80*d*, 80*e* and 80*f* for passing the fluid from the tank 122 into the respective washers 80*c*, 80*d*, 80*e* and 80*f* when their respective valves (like the valve 20** in FIG. 2) are opened.

In this example, the fluid in the tank 122 represents the fluid sources 16. The conduit 128 also is connected to the tank 122 for passing the fluid back into the tank 122. In the particular application illustrated in FIG. 8 where the fluid using system 12 comprises the washers 80, the fluid passed into the washers 80 commonly is heated. In this type of application, the tank 122 incorporates a heater or heating element (not shown) for heating the fluid in the tank 122 to a predetermined temperature level. The fluid continuously is pumped by the pump 124 and circulated through the conduit 128 and through the tank 122 so that heated fluid always is available to any one of the washers 80*c*, 80*d*, 80*e* and 80*f*.

The tank 122 also includes a level controller 130 which is adapted to sense a predetermined high liquid level and a predetermined low liquid level in the tank 122. In response to sensing a predetermined low liquid level in the tank 122, the level controller 130 outputs a signal to a valve 132 to open the valve 132 causing fluid to be passed from the fluid source (not shown) such as city water supply through the conduit 129 and a conduit 134 and into the tank 122. In response to sensing the liquid level in the tank at a predetermined high level, the level controller 130 outputs a signal to the valve 132 closing the valve 132 thereby terminating the passing of fluid from the fluid source (not shown) into the tank 122. In the event the liquid level in the tank 122 exceeds a predetermined high level, the excess fluid in the tank 122 (the fluid disposed above the predetermined high level) is passed from the tank 122 through a conduit 136 to discharge.

During each treatment reuse cycle of any of the washers 80*c*, 80*d*, 80*e* and 80*f*, the valve 58 (FIG. 2) is opened for pumping fluid from the dump tank associated with the particular washer 80*c*, 80*d*, 80*e* or 80*f* having fluid therein during the treatment reuse cycle of that particular washer. The fluid is pumped via pump 38*d* through the conduit 48 through a screen filter 138, through an equalization tank 140 and through the treatment system 70. The fluid is treated in the treatment system 70 and then passed from the treatment system 70 through the conduit 72 and into the holding tank 122 for being reused in the fluid control system 10*e*.

When any one of the washers 80*c*, 80*d*, 80*e* or 80*f* is in the treatment discharge cycle, the valve like the valve 67 (FIG. 2) is opened and the fluid is pumped from that washer 80 via a pump 38*e* through the conduit 51. The fluid is pumped through the conduit 51 and through a screen filter 142, through an equalization tank 144 and into and through a treatment system 71. The fluid is passed from the treatment system 71 for discharge to the sewer for example.

It should be noted that, in the fluid control system 10*e*, the valves 52, 58 and 67 may be eliminated since the fluid control system 10*e* incorporates three separate pumps 38*c*, 38*d* and 38*e* as opposed to the single pump 38 shown in FIG. 1.

It also should be noted that, during the treatment reuse cycle and/or the treatment discharge cycle, the fluid may be treated only using screen filters like the screen filters 138 and 142 or other such filters in lieu of the fluid treatment systems 70 and 71.

A total dissolved solids meter 150 is connected to the fluid in the conduit 128 being passed back to the washers 80. The meter 150 monitors the total dissolved solids level in the fluid being passed back into the washers 80 for reuse.

If the total dissolved solids level of the fluid in the conduit 128 exceeds the predetermined high total dissolved solids level, the meter 150 sends a signal to a valve 152 to open the valve 152. In the open position of the valve 152, make up water from the city water supply is passed into the tank 122 for being added to the fluid therein thereby lowering the level of the total dissolved solids in such fluid.

Preferably, a meter similar to the meter 150 also is connected to the fluid in the conduits 46 and 72 for monitoring the total dissolved solids level in such fluid being passed to the tank 122 for reuse in the washers 80.

In the embodiment shown in FIG. 8, a valve and TDS meter may be installed in the conduit 46 after the filter 120 so that, if the TDS level of the fluid exceeds a predetermined maximum level, the conduit 46 may be closed and the fluid directed to be discharged to the sewer. Further, a valve and TDS meter may be installed in the conduit 72 for closing the conduit 72 and directing the fluid to the sewer if the TDS level of the fluid exceeds a predetermined level.

Changes may be made in the steps or the sequence of steps of the methods described herein without departing from the spirit and scope of the invention as defined in the following claims.

What is claimed is:

1. A method utilizing a fluid using system wherein fluid is passed from the fluid using system during at least two dumping cycles occurring at predetermined periodic time intervals, comprising:

sampling during a system calibration phase, the fluid passed from the fluid using system during each dumping cycle, and designating each such sample as a fluid dumping sample corresponding to the dumping cycle during which the fluid was passed from the fluid using system;

designating, during the system calibration phase, each of the dumping cycles, based on the fluid dumping sample taken during that dumping cycle, as one of the following designations:

(a) a discharge cycle;

(b) a reuse cycle;

(c) a treatment reuse cycle; or (d) a treatment discharge cycle;

operating, during a system operating phase, in at least two of the following modes of operation:

(a) passing automatically the fluid dumped from the fluid using system during each of the discharge cycles to discharge;

(b) passing automatically the fluid dumped from the fluid using system during each of the reuse cycles back to the fluid using system;

(c) passing automatically the fluid dumped from the fluid using system during each of the treatment reuse cycles through fluid treatment system means for treating the fluid and then passing the fluid from the fluid treatment system means back into the fluid using system; and (d) passing automatically the fluid dumped from the fluid using system during each of the treatment discharge cycles through fluid treatment system means for treating the fluid and then passing the fluid from the fluid treatment system means to discharge.

2. The method of claim 1 further comprising the step of heating the fluid prior to passing the fluid back into the fluid using system during each of the reuse cycles and during each of the treatment reuse cycles.

3. A method utilizing a fluid using system wherein fluid is passed from the fluid using system during at least two dumping cycles occurring at predetermined periodic time intervals, comprising:

sampling, during a system calibration phase, the fluid passed from the fluid using system during each dumping cycle, and designating each such sample as a fluid dumping sample corresponding to the dumping cycle during which the fluid was passed from the fluid using system;

designating, during the system calibration phase, each of the dumping cycles, based on the fluid dumping sample taken during that dumping cycle, as one of the following designations:

(a) a discharge cycle;

(b) a reuse cycle;

(c) a treatment reuse cycle; or (d) a treatment discharge cycle;

operating, during a system operating phase, in at least two of the following modes of operation:

(a) passing the fluid dumped from the fluid using system during each of the discharge cycles to discharge;

(b) passing the fluid dumped from the fluid using system during each of the reuse cycles back to the fluid using system;

(c) passing the fluid dumped from the fluid using system during each of the treatment reuse cycles through fluid treatment system means for treating the fluid and then passing the fluid from the fluid treatment system means back into the fluid using system; and (d) passing the fluid dumped from the fluid using system during each of the treatment discharge cycles through fluid treatment system means for treating the fluid and then passing the fluid from the fluid treatment system means to discharge.

4. The method of claim 3 further comprising the step of heating the fluid prior to passing the fluid back into the fluid using system during each of the reuse cycles and during each of the treatment reuse cycles.

5. A method utilizing a fluid using system wherein fluid is passed from the fluid using system during at least two dumping cycles occurring at predetermined periodic time intervals and wherein the fluid passed from the fluid using system comprises at least one of dissolved solids and undissolved solids, the method, comprising:

sampling during a system calibration phase the fluid passed from the fluid using system during each dumping cycle, and designating each such sample as a fluid dumping sample corresponding to the dumping cycle during which the fluid was passed from the fluid using system;

designating, during the system calibration phase, each of the dumping cycles based on the fluid dumping sample taken during that dumping cycle as one of the following designations:

(a) a discharge cycle when the dissolved solids in the fluid dumping sample are above a predetermined total dissolved solids level and when there are substantially no undissolved solids in the fluid dumping sample;

(b) a reuse cycle when the dissolved solids in the fluid dumping sample are below the predetermined total dissolved solids level and when there are substantially no undissolved solids in the fluid dumping sample;

(c) a treatment reuse cycle when the dissolved solids in the fluid dumping sample are below the predetermined total dissolved solids level and when there are undissolved solids in the fluid dumping sample; or (d) a treatment discharge cycle when the dissolved solids in the fluid dumping sample are above the predetermined total dissolved solids level and when there are undissolved solids in the fluid dumping sample;

operating, during a system operating phase, in at least two of the following modes of operation:

(a) passing automatically the fluid dumped from the fluid using system during each of the discharge cycles to discharge;

(b) passing automatically the fluid dumped from the fluid using system during each of the reuse cycles back to the fluid using system;

(c) passing automatically the fluid dumped from the fluid using system during each of the treatment reuse cycles through fluid treatment system means for reducing the undissolved solids in the fluid and then passing the fluid from said fluid treatment system means back into the fluid using system;

(d) passing automatically the fluid dumped from the fluid using system during each of the treatment discharge cycles through fluid treatment system means for reducing the undissolved solids in the fluid and then passing the fluid from said fluid treatment system means to discharge.

6. The method of claim 5 further comprising the step of heating the fluid prior to passing the fluid back into the fluid using system during each of the reuse cycles and during each of the treatment reuse cycles.

7. A method utilizing a fluid using system wherein fluid is passed from the fluid using system during at least two dumping cycles occurring at predetermined periodic time intervals and wherein the fluid passed from the fluid using system comprises at least one of dissolved solids and undissolved solids, the method, comprising:

sampling during a system calibration phase the fluid passed from the fluid using system during each dumping cycle, and designating each such sample as a fluid dumping sample corresponding to the dumping cycle during which the fluid was passed from the fluid using system;

designating, during the system calibration phase, each of the dumping cycles based on the fluid dumping sample taken during that dumping cycle as one of the following designations:

(a) a discharge cycle when the dissolved solids in the fluid dumping sample are above a predetermined total dissolved solids level and when there are substantially no undissolved solids in the fluid dumping sample;

(b) a reuse cycle when the dissolved solids in the fluid dumping sample are below the predetermined total dissolved solids level and when there are substantially no undissolved solids in the fluid dumping sample;

(c) a treatment reuse cycle when the dissolved solids in the fluid dumping sample are below the predetermined total dissolved solids level and when there are undissolved solids in the fluid dumping sample; or (d) a treatment discharge cycle when the dissolved solids in the fluid dumping sample are above the predetermined total dissolved solids level and when there are undissolved solids in the fluid dumping sample;

operating, during a system operating phase, in at least two of the following modes of operation:

(a) passing the fluid dumped from the fluid using system during each of the discharge cycles to discharge;

(b) passing the fluid dumped from the fluid using system during each of the reuse cycles back to the fluid using system;

(c) passing the fluid dumped from the fluid using system during each of the treatment reuse cycles through fluid treatment system means for reducing the undissolved solids in the fluid and then passing the fluid from said fluid treatment system means back into the fluid using system;

(d) passing the fluid dumped from the fluid using system during each of the treatment discharge cycles through fluid treatment system means for reducing the undissolved solids in the fluid and then passing the fluid from said fluid treatment system means to discharge.

8. The method of claim 7 further comprising the step of heating the fluid prior to passing the fluid back into the fluid using system during each of the reuse cycles and during each of the treatment reuse cycles.

9. A method utilizing a fluid using system wherein fluid is passed from the fluid using system during at least two dumping cycles occurring at predetermined periodic time intervals and wherein the fluid passed from the fluid using system comprises at least one of dissolved solids and undissolved solids, the method, comprising:

sampling during a system calibration phase the fluid passed from the fluid using system during each dumping cycle, and designating each such sample as a fluid dumping sample corresponding to the dumping cycle during which the fluid was passed from the fluid using system;

designating, during the system calibration phase, each of the dumping cycles based on the fluid dumping sample taken during that dumping cycle as one of the following designations:

(a) a discharge cycle when the dissolved solids in the fluid dumping sample is above a predetermined total dissolved solids level;

(b) a reuse cycle when the dissolved solids level in the fluid dumping sample is below the predetermined total dissolved solids level;

(c) a treatment reuse cycle when the dissolved solids in the fluid dumping sample are below the predetermined total dissolved solids level and when there are undissolved solids in the fluid dumping sample; or (d) a treatment discharge cycle when the dissolved solids in the fluid dumping sample are above the predetermined total dissolved solids level and when there are undissolved solids in the fluid dumping sample;

operating, during a system operating phase, in at least two of the following modes of operation:

(a) passing automatically the fluid dumped from the fluid using system during each of the discharge cycles to discharge;

(b) passing automatically the fluid dumped from the fluid using system during each of the reuse cycles back to the fluid using system;

(c) passing automatically the fluid dumped from the fluid using system during each of the treatment reuse cycles through fluid treatment system means for reducing the undissolved solids in the fluid and then passing the fluid from said fluid treatment system means back into the fluid using system;

(d) passing automatically the fluid dumped from the fluid using system during each of the treatment discharge cycles through fluid treatment system means for reducing the undissolved solids in the fluid and then passing the fluid from said fluid treatment system means to discharge.

10. The method of claim 9 further comprising the step of heating the fluid prior to passing the fluid back into the fluid using system during each of the reuse cycles and during each of the treatment reuse cycles.

11. A method utilizing a fluid using system wherein fluid is passed from the fluid using system during at least two dumping cycles occurring at predetermined periodic time intervals and wherein the fluid passed from the fluid using system comprises at least one of dissolved solids and undissolved solids, the method, comprising:

sampling during a system calibration phase the fluid passed from the fluid using system during each dumping cycle, and designating each such sample as a fluid dumping sample corresponding to the dumping cycle during which the fluid was passed from the fluid using system;

designating, during the system calibration phase, each of the dumping cycles based on the fluid dumping sample taken during that dumping cycle as one of the following designations:

(a) a discharge cycle when the dissolved solids in the fluid dumping sample is above a predetermined total dissolved solids level;

(b) a reuse cycle when the dissolved solids level in the fluid dumping sample is below the predetermined total dissolved solids level;

(c) a treatment reuse cycle when the dissolved solids in the fluid dumping sample are below the predetermined total dissolved solids level and when there are undissolved solids in the fluid dumping sample; or (d) a treatment discharge cycle when the dissolved solids in the fluid dumping sample are above the predetermined total dissolved solids level and when there are undissolved solids in the fluid dumping sample;

operating, during a system operating phase, in at least two of the following modes of operation:

(a) passing the fluid dumped from the fluid using system during each of the discharge cycles to discharge;

(b) passing the fluid dumped from the fluid using system during each of the reuse cycles back to the fluid using system;

(c) passing the fluid dumped from the fluid using system during each of the treatment reuse cycles through fluid treatment system means for reducing the undissolved solids in the fluid and then passing the fluid from said fluid treatment system means back into the fluid using system;

(d) passing the fluid dumped from the fluid using system during each of the treatment discharge cycles through fluid treatment system means for reducing the undissolved solids in the fluid and then passing the fluid from said fluid treatment system means to discharge.

12. The method of claim 11 further comprising the step of heating the fluid prior to passing the fluid back into the fluid using system during each of the reuse cycles and during each of the treatment reuse cycles.

13. A method utilizing a plurality of fluid using systems wherein fluid is passed from each of the fluid using systems during at least two dumping cycles occurring at predetermined periodic time intervals, comprising:

sampling during a system calibration phase, the fluid passed from each of the fluid using systems during each dumping cycle, and designating each such sample as a fluid dumping sample corresponding to the dumping cycle during which the fluid was passed from the fluid using system;

designating, during the system calibration phase, each of the dumping cycles, based on the fluid dumping sample taken during that dumping cycle, as one of the following designations:

(a) a discharge cycle;

(b) a reuse cycle;

(c) a treatment reuse cycle; or (d) a treatment discharge cycle;

operating, during a system operating phase, in at least two of the following modes of operation:

(a) passing automatically the fluid dumped from each of the fluid using systems during each of the discharge cycles to discharge;

(b) passing automatically the fluid dumped from each of the fluid using systems during each of the reuse cycles back to fluid using systems;

(c) passing automatically the fluid dumped from each of the fluid using systems during each of the treatment reuse cycles through fluid treatment system means for treating the fluid and then passing the fluid from the fluid treatment system means back into fluid using systems; and (d) passing automatically the fluid dumped from each of the fluid using systems during each of the treatment discharge cycles through fluid treatment system means for treating the fluid and then passing the fluid from the fluid treatment system means to discharge.

14. The method of claim 13 further comprising the step of heating the fluid prior to passing the fluid back into the fluid using systems during each of the reuse cycles and during each of the treatment reuse cycles.

15. A method utilizing a plurality of fluid using systems wherein fluid is passed from each of the fluid using systems during at least two dumping cycles occurring at predetermined periodic time intervals, comprising:

sampling, during a system calibration phase, the fluid passed from each of the fluid using systems during each dumping cycle, and designating each such sample as a fluid dumping sample corresponding to the dumping cycle during which the fluid was passed from the fluid using system;

designating, during the system calibration phase, each of the dumping cycles, based on the fluid dumping sample taken during that dumping cycle, as one of the following designations:

(a) a discharge cycle;

(b) a reuse cycle;

(c) a treatment reuse cycle; or (d) a treatment discharge cycle;

operating, during a system operating phase, in at least two of the following modes of operation:

(a) passing the fluid dumped from each of the fluid using systems during each of the discharge cycles to discharge;

(b) passing the fluid dumped from each of the fluid using systems during each of the reuse cycles back to the fluid using systems;

(c) passing the fluid dumped from each of the fluid using systems during each of the treatment reuse cycles through fluid treatment system means for treating the fluid and then passing the fluid from the fluid treatment system means back into the fluid using systems; and (d) passing the fluid dumped from each of the fluid using systems during each of the treatment discharge cycles through fluid treatment system means for treating the fluid and then passing the fluid from the fluid treatment system means to discharge.

16. The method of claim 15 further comprising the step of heating the fluid prior to passing the fluid back into the fluid using systems during each of the reuse cycles and during each of the treatment reuse cycles.

17. A method utilizing a plurality of fluid using systems wherein fluid is passed from each of the fluid using systems during at least two dumping cycles occurring at predetermined periodic time intervals and wherein the fluid passed from the fluid using systems comprises at least one of dissolved solids and undissolved solids, the method, comprising:

sampling during a system calibration phase the fluid passed from each of the fluid using systems during each dumping cycle, and designating each such sample as a fluid dumping sample corresponding to the dumping cycle during which the fluid was passed from the fluid using system;

designating, during the system calibration phase, each of the dumping cycles based on the fluid dumping sample taken during that dumping cycle as one of the following designations:

(a) a discharge cycle when the dissolved solids in the fluid dumping sample are above a predetermined total dissolved solids level and when there are substantially no undissolved solids in the fluid dumping sample;

(b) a reuse cycle when the dissolved solids in the fluid dumping sample are below the predetermined total dissolved solids level and when there are substantially no undissolved solids in the fluid dumping sample;

(c) a treatment reuse cycle when the dissolved solids in the fluid dumping sample are below the predetermined total dissolved solids level and when there are undissolved solids in the fluid dumping sample; or (d) a treatment discharge cycle when the dissolved solids in the fluid dumping sample are above the predetermined total dissolved solids level and when there are undissolved solids in the fluid dumping sample;

operating, during a system operating phase, in at least two of the following modes of operation:

(a) passing automatically the fluid dumped from each of the fluid using systems during each of the discharge cycles to discharge;

(b) passing automatically the fluid dumped from each of the fluid using systems during each of the reuse cycles back to the fluid using systems;

(c) passing automatically the fluid dumped from each of the fluid using systems during each of the treatment reuse cycles through fluid treatment system means for reducing the undissolved solids in the fluid and then passing the fluid from said fluid treatment system means back into the fluid using systems;

(d) passing automatically the fluid dumped from each of the fluid using systems during each of the treatment discharge cycles through fluid treatment system means for reducing the undissolved solids in the fluid and then passing the fluid from said fluid treatment system means to discharge.

18. The method of claim 17 further comprising the step of heating the fluid prior to passing the fluid back into the fluid using systems during each of the reuse cycles and during each of the treatment reuse cycles.

19. A method utilizing a plurality of fluid using systems wherein fluid is passed from each of the fluid using systems during at least two dumping cycles occurring at predetermined periodic time intervals and wherein the fluid passed from the fluid using systems comprises at least one of dissolved solids and undissolved solids, the method, comprising:

sampling during a system calibration phase the fluid passed from each of the fluid using systems during each dumping cycle, and designating each such sample as a fluid dumping sample corresponding to the dumping cycle during which the fluid was passed from the fluid using system;

designating, during the system calibration phase, each of the dumping cycles based on the fluid dumping sample taken during that dumping cycle as one of the following designations:

(a) a discharge cycle when the dissolved solids in the fluid dumping sample is above a predetermined total dissolved solids level;

(b) a reuse cycle when the dissolved solids level in the fluid dumping sample is below the predetermined total dissolved solids level;

(c) a treatment reuse cycle when the dissolved solids in the fluid dumping sample are below the predetermined total dissolved solids level and when there are undissolved solids in the fluid dumping sample; or (d) a treatment discharge cycle when the dissolved solids in the fluid dumping sample are above the predetermined total dissolved solids level and when there are undissolved solids in the fluid dumping sample;

operating, during a system operating phase, in at least two of the following modes of operation:

(a) passing automatically the fluid dumped from the fluid using systems during each of the discharge cycles to discharge;

(b) passing automatically the fluid dumped from the fluid using systems during each of the reuse cycles back to the fluid using system;

(c) passing automatically the fluid dumped from the fluid using systems during each of the treatment reuse cycles through fluid treatment system means for reducing the undissolved solids in the fluid and then passing the fluid from said fluid treatment system means back into the fluid using system;

(d) passing automatically the fluid dumped from the fluid using systems during each of the treatment discharge cycles through fluid treatment system means for reducing the undissolved solids in the fluid and then passing the fluid from said fluid treatment system means to discharge.

20. The method of claim 19 further comprising the step of heating the fluid prior to passing the fluid back into the fluid using systems during each of the reuse cycles and during each of the treatment reuse cycles.

21. A method utilizing a plurality of fluid using systems wherein fluid is passed from each of the fluid using systems during at least two dumping cycles occurring at predetermined periodic time intervals and wherein the fluid passed from the fluid using systems comprises at least one of dissolved solids and undissolved solids, the method, comprising:

sampling during a system calibration phase the fluid passed from each of the fluid using systems during each dumping cycle, and designating each such sample as a fluid dumping sample corresponding to the dumping cycle during which the fluid was passed from the fluid using system;

designating, during the system calibration phase, each of the dumping cycles based on the fluid dumping sample taken during that dumping cycle as one of the following designations:

(a) a discharge cycle when the dissolved solids in the fluid dumping sample is above a predetermined total dissolved solids level;

(b) a reuse cycle when the dissolved solids level in the fluid dumping sample is below the predetermined total dissolved solids level;

(c) a treatment reuse cycle when the dissolved solids in the fluid dumping sample are below the predetermined total dissolved solids level and when there are undissolved solids in the fluid dumping sample; or (d) a treatment discharge cycle when the dissolved solids in the fluid dumping sample are above the predetermined total dissolved solids level and when there are undissolved solids in the fluid dumping sample;

operating, during a system operating phase, in at least two of the following modes of operation:

(a) passing automatically the fluid dumped from each of the fluid using systems during each of the discharge cycles to discharge;

(b) passing automatically the fluid dumped from each of the fluid using systems during each of the reuse cycles back to the fluid using system;

(c) passing automatically the fluid dumped from each of the fluid using system during each of the treatment reuse cycles through fluid treatment system means for reducing the undissolved solids in the fluid and then passing the fluid from said fluid treatment system means back into the fluid using systems;

(d) passing automatically the fluid dumped from each of the fluid using systems during each of the treatment discharge cycles through fluid treatment system means for reducing the undissolved solids in the fluid and then passing the fluid from said fluid treatment system means to discharge.

22. The method of claim 21 further comprising the step of heating the fluid prior to passing the fluid back into the fluid using systems during each of the reuse cycles and during each of the treatment reuse cycles.

23. A method utilizing a plurality of fluid using systems wherein fluid is passed from each of the fluid using systems during at least two dumping cycles occurring at predetermined periodic time intervals and wherein the fluid passed from the fluid using systems comprises at least one of dissolved solids and undissolved solids, the method, comprising:

sampling during a system calibration phase the fluid passed from each of the fluid using systems during each dumping cycle, and designating each such sample as a fluid dumping sample corresponding to the dumping cycle during which the fluid was passed from the fluid using system;

designating, during the system calibration phase, each of the dumping cycles based on the fluid dumping sample taken during that dumping cycle as one of the following designations:

(a) a discharge cycle when the dissolved solids in the fluid dumping sample is above a predetermined total dissolved solids level;

(b) a reuse cycle when the dissolved solids level in the fluid dumping sample is below the predetermined total dissolved solids level;

(c) a treatment reuse cycle when the dissolved solids in the fluid dumping sample are below the predetermined total dissolved solids level and when there are undissolved solids in the fluid dumping sample; or (d) a treatment discharge cycle when the dissolved solids in the fluid dumping sample are above the predetermined total dissolved solids level and when there are undissolved solids in the fluid dumping sample;

operating, during a system operating phase, in at least two of the following modes of operation:

(a) passing the fluid dumped from each of the fluid using systems during each of the discharge cycles to discharge;

(b) passing the fluid dumped from each of the fluid using systems during each of the reuse cycles back to the fluid using systems;

(c) passing the fluid dumped from each of the fluid using systems during each of the treatment reuse cycles through fluid treatment system means for reducing the undissolved solids in the fluid and then passing the fluid from said fluid treatment system means back into the fluid using systems;

(d) passing the fluid dumped from each of the fluid using systems during each of the treatment discharge cycles through fluid treatment system means for reducing the undissolved solids in the fluid and then passing the fluid from said fluid treatment system means to discharge.

24. The method of claim 23 further comprising the step of heating the fluid prior to passing the fluid back into the fluid using systems during each of the reuse cycles and during each of the treatment reuse cycles.

25. A method utilizing a washer wherein fluid is passed from the washer during at least two dumping cycles occurring at predetermined periodic time intervals, comprising:

sampling during a system calibration phase, the fluid passed from the washer during each dumping cycle, and designating each such sample as a fluid dumping sample corresponding to the dumping cycle during which the fluid was passed from the washer;

designating, during the system calibration phase, each of the dumping cycles, based on the fluid dumping sample taken during that dumping cycle, as one of the following designations:

(a) a discharge cycle;

(b) a reuse cycle;

(c) a treatment reuse cycle; or (d) a treatment discharge cycle;

operating, during a system operating phase, in at least two of the following modes of operation:

(a) passing automatically the fluid dumped from the washer during each of the discharge cycles to discharge;

(b) passing automatically the fluid dumped from the washer during each of the reuse cycles back to the washer;

(c) passing automatically the fluid dumped from the washer during each of the treatment reuse cycles through fluid treatment system means for treating the fluid and then passing the fluid from the fluid treatment system means back into the washer; and (d) passing automatically the fluid dumped from the washer during each of the treatment discharge cycles through fluid treatment system means for treating the fluid and then passing the fluid from the fluid treatment system means to discharge.

26. The method of claim 25 further comprising the step of heating the fluid prior to passing the fluid back into the washers during each of the reuse cycles and during each of the treatment reuse cycles.

27. A method utilizing a washer wherein fluid is passed from the washer during at least two dumping cycles occurring at predetermined periodic time intervals, comprising:

sampling, during a system calibration phase, the fluid passed from the washer during each dumping cycle, and designating each such sample as a fluid dumping sample corresponding to the dumping cycle during which the fluid was passed from the washer;

designating, during the system calibration phase, each of the dumping cycles, based on the fluid dumping sample taken during that dumping cycle, as one of the following designations:

(a) a discharge cycle;

(b) a reuse cycle;

(c) a treatment reuse cycle; or (d) a treatment discharge cycle;

operating, during a system operating phase, in at least two of the following modes of operation:

(a) passing the fluid dumped from the washer during each of the discharge cycles to discharge;

(b) passing the fluid dumped from the washer during each of the reuse cycles back to the washer;

(c) passing the fluid dumped from the washer during each of the treatment reuse cycles through fluid treatment system means for treating the fluid and then passing the fluid from the fluid treatment system means back into the washer; and (d) passing the fluid dumped from the washer during each of the treatment discharge cycles through fluid treatment system means for treating the fluid and then passing the fluid from the fluid treatment system means to discharge.

28. The method of claim 27 further comprising the step of heating the fluid prior to passing the fluid back into the washers during each of the reuse cycles and during each of the treatment reuse cycles.

29. A method utilizing a washer wherein fluid is passed from the washer during at least two dumping cycles occurring at predetermined periodic time intervals and wherein the fluid passed from the washer comprises at least one of dissolved solids and undissolved solids, the method, comprising:

sampling during a system calibration phase the fluid passed from the washer during each dumping cycle, and designating each such sample as a fluid dumping sample corresponding to the dumping cycle during which the fluid was passed from the washer;

designating, during the system calibration phase, each of the dumping cycles based on the fluid dumping sample taken during that dumping cycle as one of the following designations:

(a) a discharge cycle when the dissolved solids in the fluid dumping sample are above a predetermined total dissolved solids level and when there are substantially no undissolved solids in the fluid dumping sample;

(b) a reuse cycle when the dissolved solids in the fluid dumping sample are below the predetermined total dissolved solids level and when there are substantially no undissolved solids in the fluid dumping sample;

(c) a treatment reuse cycle when the dissolved solids in the fluid dumping sample are below the predetermined total dissolved solids level and when there are undissolved solids in the fluid dumping sample; or (d) a treatment discharge cycle when the dissolved solids in the fluid dumping sample are above the predetermined total dissolved solids level and when there are undissolved solids in the fluid dumping sample;

operating, during a system operating phase, in at least two of the following modes of operation:

(a) passing automatically the fluid dumped from the washer during each of the discharge cycles to discharge;

(b) passing automatically the fluid dumped from the washer during each of the reuse cycles back to the washer;

(c) passing automatically the fluid dumped from the washer during each of the treatment reuse cycles through fluid treatment system means for reducing the undissolved solids in the fluid and then passing the fluid from said fluid treatment system means back into the washer;

(d) passing automatically the fluid dumped from the washer during each of the treatment discharge cycles through fluid treatment system means for reducing the undissolved solids in the fluid and then passing the fluid from said fluid treatment system means to discharge.

30. The method of claim 29 further comprising the step of heating the fluid prior to passing the fluid back into the washers during each of the reuse cycles and during each of the treatment reuse cycles.

31. A method utilizing a washer wherein fluid is passed from the washer during at least two dumping cycles occurring at predetermined periodic time intervals and wherein the fluid passed from the washer comprises at least one of dissolved solids and undissolved solids, the method, comprising:

sampling during a system calibration phase the fluid passed from the washer during each dumping cycle, and designating each such sample as a fluid dumping sample corresponding to the dumping cycle during which the fluid was passed from the washer;

designating, during the system calibration phase, each of the dumping cycles based on the fluid dumping sample taken during that dumping cycle as one of the following designations:

(a) a discharge cycle when the dissolved solids in the fluid dumping sample are above a predetermined total dissolved solids level and when there are substantially no undissolved solids in the fluid dumping sample;

(b) a reuse cycle when the dissolved solids in the fluid dumping sample are below the predetermined total dissolved solids level and when there are substantially no undissolved solids in the fluid dumping sample;

(c) a treatment reuse cycle when the dissolved solids in the fluid dumping sample are below the predetermined total dissolved solids level and when there are undissolved solids in the fluid dumping sample; or (d) a treatment discharge cycle when the dissolved solids in the fluid dumping sample are above the predetermined total dissolved solids level and when there are undissolved solids in the fluid dumping sample;

operating, during a system operating phase, in at least two of the following modes of operation:

(a) passing the fluid dumped from the washer during each of the discharge cycles to discharge;

(b) passing the fluid dumped from the washer during each of the reuse cycles back to the washer;

(c) passing the fluid dumped from the washer during each of the treatment reuse cycles through fluid treatment system means for reducing the undissolved solids in the fluid and then passing the fluid from said fluid treatment system means back into the washer;

(d) passing the fluid dumped from the washer during each of the treatment discharge cycles through fluid treatment system means for reducing the undissolved solids in the fluid and then passing the fluid from said fluid treatment system means to discharge.

32. The method of claim 31 further comprising the step of heating the fluid prior to passing the fluid back into the washers during each of the reuse cycles and during each of the treatment reuse cycles.

33. A method utilizing a washer wherein fluid is passed from the washer during at least two dumping cycles occurring at predetermined periodic time intervals and wherein the fluid passed from the washer comprises at least one of dissolved solids and undissolved solids, the method, comprising:

sampling during a system calibration phase the fluid passed from the washer during each dumping cycle, and designating each such sample as a fluid dumping sample corresponding to the dumping cycle during which the fluid was passed from the washer;

designating, during the system calibration phase, each of the dumping cycles based on the fluid dumping sample taken during that dumping cycle as one of the following designations:

(a) a discharge cycle when the dissolved solids in the fluid dumping sample are above a predetermined total dissolved solids level;
(b) a reuse cycle when the dissolved solids level in the fluid dumping sample is below the predetermined total dissolved solids level;
(c) a treatment reuse cycle when the dissolved solids in the fluid dumping sample are below the predetermined total dissolved solids level and when there are undissolved solids in the fluid dumping sample; or
(d) a treatment discharge cycle when the dissolved solids in the fluid dumping sample are above the predetermined total dissolved solids level and when there are undissolved solids in the fluid dumping sample;

operating, during a system operating phase, in at least two of the following modes of operation:
(a) passing automatically the fluid dumped from the washer during each of the discharge cycles to discharge;
(b) passing automatically the fluid dumped from the washer during each of the reuse cycles back to the washer;
(c) passing automatically the fluid dumped from the washer during each of the treatment reuse cycles through fluid treatment system means for reducing the undissolved solids in the fluid and then passing the fluid from said fluid treatment system means back into the washer;
(d) passing automatically the fluid dumped from the washer during each of the treatment discharge cycles through fluid treatment system means for reducing the undissolved solids in the fluid and then passing the fluid from said fluid treatment system means to discharge.

34. The method of claim 33 further comprising the step of heating the fluid prior to passing the fluid back into the washer during each of the reuse cycles and during each of the treatment reuse cycles.

35. A method utilizing a washer wherein fluid is passed from the washer during at least two dumping cycles occurring at predetermined periodic time intervals and wherein the fluid passed from the washer comprises at least one of dissolved solids and undissolved solids, the method, comprising:

sampling during a system calibration phase the fluid passed from the washer during each dumping cycle, and designating each such sample as a fluid dumping sample corresponding to the dumping cycle during which the fluid was passed from the washer;

designating, during the system calibration phase, each of the dumping cycles based on the fluid dumping sample taken during that dumping cycle as one of the following designations:
(a) a discharge cycle when the dissolved solids in the fluid dumping sample is above a predetermined total dissolved solids level;
(b) a reuse cycle when the dissolved solids level in the fluid dumping sample is below the predetermined total dissolved solids level;
(c) a treatment reuse cycle when the dissolved solids in the fluid dumping sample are below the predetermined total dissolved solids level and when there are undissolved solids in the fluid dumping sample; or
(d) a treatment discharge cycle when the dissolved solids in the fluid dumping sample are above the predetermined total dissolved solids level and when there are undissolved solids in the fluid dumping sample;

operating, during a system operating phase, in at least two of the following modes of operation:
(a) passing the fluid dumped from the washer during each of the discharge cycles to discharge;
(b) passing the fluid dumped from the washer during each of the reuse cycles back to the washer;
(c) passing the fluid dumped from the washer during each of the treatment reuse cycles through fluid treatment system means for reducing the undissolved solids in the fluid and then passing the fluid from said fluid treatment system means back into the washer;
(d) passing the fluid dumped from the washer during each of the treatment discharge cycles through fluid treatment system means for reducing the undissolved solids in the fluid and then passing the fluid from said fluid treatment system means to discharge.

36. The method of claim 35 further comprising the step of heating the fluid prior to passing the fluid back into the washer during each of the reuse cycles and during each of the treatment reuse cycles.

37. A method utilizing a plurality of washers wherein fluid is passed from each of the washers during at least two dumping cycles occurring at predetermined periodic time intervals, comprising:

sampling during a system calibration phase, the fluid passed from each of the washers during each dumping cycle, and designating each such sample as a fluid dumping sample corresponding to the dumping cycle during which the fluid was passed from the washer;

designating, during the system calibration phase, each of the dumping cycles, based on the fluid dumping sample taken during that dumping cycle, as one of the following designations:
(a) a discharge cycle;
(b) a reuse cycle;
(c) a treatment reuse cycle; or
(d) a treatment discharge cycle;

operating, during a system operating phase, in at least two of the following modes of operation:
(a) passing automatically the fluid dumped from each of the washers during each of the discharge cycles to discharge;
(b) passing automatically the fluid dumped from each of the washers during each of the reuse cycles back to the washers;
(c) passing automatically the fluid dumped from each of the washers during each of the treatment reuse cycles through fluid treatment system means for treating the fluid and then passing the fluid from the fluid treatment system means back into the washers;
(d) passing automatically the fluid dumped from each of the washers during each of the treatment discharge cycles through fluid treatment system means for treating the fluid and then passing the fluid from the fluid treatment system means to discharge.

38. The method of claim 37 further comprising the step of heating the fluid prior to passing the fluid back into the washers during each of the reuse cycles and during each of the treatment reuse cycles.

39. A method utilizing a plurality of washers wherein fluid is passed from each of the washers during at least two dumping cycles occurring at predetermined periodic time intervals, comprising:

sampling, during a system calibration phase, the fluid passed from each of the washers during each dumping cycle, and designating each such sample as a fluid dumping sample corresponding to the dumping cycle during which the fluid was passed from the washers;

designating, during the system calibration phase, each of the dumping cycles, based on the fluid dumping sample taken during that dumping cycle, as one of the following designations:

(a) a discharge cycle;

(b) a reuse cycle;

(c) a treatment reuse cycle; or (d) a treatment discharge cycle;

operating, during a system operating phase, in at least two of the following modes of operation:

(a) passing the fluid dumped from each of the washers during each of the discharge cycles to discharge;

(b) passing the fluid dumped from each of the washers during each of the reuse cycles back to the washers;

(c) passing the fluid dumped from each of the washers during each of the treatment reuse cycles through fluid treatment system means for treating the fluid and then passing the fluid from the fluid treatment system means back into the washers;

(d) passing the fluid dumped from each of the washers during each of the treatment discharge cycles through fluid treatment system means for treating the fluid and then passing the fluid from the fluid treatment system means to discharge.

40. The method of claim 39 further comprising the step of heating the fluid prior to passing the fluid back into the washers during each of the reuse cycles and during each of the treatment reuse cycles.

41. A method utilizing a plurality of washers wherein fluid is passed from each of the washers during at least two dumping cycles occurring at predetermined periodic time intervals and wherein the fluid passed from the washers comprises at least one of dissolved solids and undissolved solids, the method, comprising:

sampling during a system calibration phase the fluid passed from each of the washers during each dumping cycle, and designating each such sample as a fluid dumping sample corresponding to the dumping cycle during which the fluid was passed from the washer;

designating, during the system calibration phase, each of the dumping cycles based on the fluid dumping sample taken during that dumping cycle as one of the following designations:

(a) a discharge cycle when the dissolved solids in the fluid dumping sample are above a predetermined total dissolved solids level and when there are substantially no undissolved solids in the fluid dumping sample;

(b) a reuse cycle when the dissolved solids in the fluid dumping sample are below the predetermined total dissolved solids level and when there are substantially no undissolved solids in the fluid dumping sample;

(c) a treatment reuse cycle when the dissolved solids in the fluid dumping sample are below the predetermined total dissolved solids level and when there are undissolved solids in the fluid dumping sample; or (d) a treatment discharge cycle when the dissolved solids in the fluid dumping sample are above the predetermined total dissolved solids level and when there are undissolved solids in the fluid dumping sample;

operating, during a system operating phase, in at least two of the following modes of operation:

(a) passing automatically the fluid dumped from each of the washers during each of the discharge cycles to discharge;

(b) passing automatically the fluid dumped from each of the washers during each of the reuse cycles back to the washers;

(c) passing automatically the fluid dumped from each of the washers during each of the treatment reuse cycles through fluid treatment system means for reducing the undissolved solids in the fluid and then passing the fluid from said fluid treatment system means back into the washers;

(d) passing automatically the fluid dumped from each of the washer during each of the treatment discharge cycles through fluid treatment system means for reducing the undissolved solids in the fluid and then passing the fluid from said fluid treatment system means to discharge.

42. The method of claim 41 further comprising the step of heating the fluid prior to passing the fluid back into the washers during each of the reuse cycles and during each of the treatment reuse cycles.

43. A method utilizing a plurality of washers wherein fluid is passed from each of the washers during at least two dumping cycles occurring at predetermined periodic time intervals and wherein the fluid passed from the washers comprises at least one of dissolved solids and undissolved solids, the method, comprising:

sampling during a system calibration phase the fluid passed from each of the washers during each dumping cycle, and designating each such sample as a fluid dumping sample corresponding to the dumping cycle during which the fluid was passed from the washer;

designating, during the system calibration phase, each of the dumping cycles based on the fluid dumping sample taken during that dumping cycle as one of the following designations:

(a) a discharge cycle when the dissolved solids in the fluid dumping sample is above a predetermined total dissolved solids level;

(b) a reuse cycle when the dissolved solids level in the fluid dumping sample is below the predetermined total dissolved solids level;

(c) a treatment reuse cycle when the dissolved solids in the fluid dumping sample are below the predetermined total dissolved solids level and when there are undissolved solids in the fluid dumping sample; or (d) a treatment discharge cycle when the dissolved solids in the fluid dumping sample are above the predetermined total dissolved solids level and when there are undissolved solids in the fluid dumping sample;

operating, during a system operating phase, in at least two of the following modes of operation:

(a) passing automatically the fluid dumped from the washers during each of the discharge cycles to discharge;

(b) passing automatically the fluid dumped from the washers during each of the reuse cycles back to the washers;

(c) passing automatically the fluid dumped from the washers during each of the treatment reuse cycles through fluid treatment system means for reducing the undissolved solids in the fluid and then passing the fluid from said fluid treatment system means back into the washers;

(d) passing automatically the fluid dumped from the washers during each of the treatment discharge cycles through fluid treatment system means for reducing the undissolved solids in the fluid and then passing the fluid from said fluid treatment system means to discharge.

44. The method of claim 43 further comprising the step of heating the fluid prior to passing the fluid back into the washers during each of the reuse cycles and during each of the treatment reuse cycles.

45. A method utilizing a plurality of washers wherein fluid is passed from each of the washers during at least two dumping cycles occurring at predetermined periodic time intervals and wherein the fluid passed from the washers comprises at least one of dissolved solids and undissolved solids, the method, comprising:

sampling during a system calibration phase the fluid passed from each of the washers during each dumping cycle, and designating each such sample as a fluid dumping sample corresponding to the dumping cycle during which the fluid was passed from the washers;

designating, during the system calibration phase, each of the dumping cycles based on the fluid dumping sample taken during that dumping cycle as one of the following designations:

(a) a discharge cycle when the dissolved solids in the fluid dumping sample is above a predetermined total dissolved solids level;

(b) a reuse cycle when the dissolved solids level in the fluid dumping sample is below the predetermined total dissolved solids level;

(c) a treatment reuse cycle when the dissolved solids in the fluid dumping sample are below the predetermined total dissolved solids level and when there are undissolved solids in the fluid dumping sample; or (d) a treatment discharge cycle when the dissolved solids in the fluid dumping sample are above the predetermined total dissolved solids level and when there are undissolved solids in the fluid dumping sample;

operating, during a system operating phase, in at least two of the following modes of operation:

(a) passing automatically the fluid dumped from each of the washers during each of the discharge cycles to discharge;

(b) passing automatically the fluid dumped from each of the washers during each of the reuse cycles back to the washers;

(c) passing automatically the fluid dumped from each of the washers during each of the treatment reuse cycles through fluid treatment system means for reducing the undissolved solids in the fluid and then passing the fluid from said fluid treatment system means back into the washers;

(d) passing automatically the fluid dumped from each of the washers during each of the treatment discharge cycles through fluid treatment system means for reducing the undissolved solids in the fluid and then passing the fluid from said fluid treatment system means to discharge.

46. The method of claim 45 further comprising the step of heating the fluid prior to passing the fluid back into the washers during each of the reuse cycles and during each of the treatment reuse cycles.

47. A method utilizing a plurality of washers wherein fluid is passed from each of the washers during at least two dumping cycles occurring at predetermined periodic time intervals and wherein the fluid passed from the washers comprises at least one of dissolved solids and undissolved solids, the method, comprising:

sampling during a system calibration phase the fluid passed from each of the washers during each dumping cycle, and designating each such sample as a fluid dumping sample corresponding to the dumping cycle during which the fluid was passed from the washer;

designating, during the system calibration phase, each of the dumping cycles based on the fluid dumping sample taken during that dumping cycle as one of the following designations:

(a) a discharge cycle when the dissolved solids in the fluid dumping sample is above a predetermined total dissolved solids level;

(b) a reuse cycle when the dissolved solids level in the fluid dumping sample is below the predetermined total dissolved solids level;

(c) a treatment reuse cycle when the dissolved solids in the fluid dumping sample are below the predetermined total dissolved solids level and when there are undissolved solids in the fluid dumping sample; or (d) a treatment discharge cycle when the dissolved solids in the fluid dumping sample are above the predetermined total dissolved solids level and when there are undissolved solids in the fluid dumping sample;

operating, during a system operating phase, in at least two of the following modes of operation:

(a) passing the fluid dumped from each of the washers during each of the discharge cycles to discharge;

(b) passing the fluid dumped from each of the washers during each of the reuse cycles back to the washers;

(c) passing the fluid dumped from each of the washers during each of the treatment reuse cycles through fluid treatment system means for reducing the undissolved solids in the fluid and then passing the fluid from said fluid treatment system means back into the washers;

(d) passing the fluid dumped from each of the washers during each of the treatment discharge cycles through fluid treatment system means for reducing the undissolved solids in the fluid and then passing the fluid from said fluid treatment system means to discharge.

48. The method of claim 47 further comprising the step of heating the fluid prior to passing the fluid back into the washers during each of the reuse cycles and during each of the treatment reuse cycles.

* * * * *